US011427883B2

(12) United States Patent
Brandstaetter

(10) Patent No.: US 11,427,883 B2
(45) Date of Patent: Aug. 30, 2022

(54) SEALING DEVICE FOR A CONTINUOUS FURNACE

(71) Applicant: SMS group GmbH, Düsseldorf (DE)

(72) Inventor: Dieter Brandstaetter, Salzburg (AT)

(73) Assignee: SMS group GmbH, Düsseldorf (DE)

( * ) Notice: Subject to any disclaimer, the term of this patent is extended or adjusted under 35 U.S.C. 154(b) by 618 days.

(21) Appl. No.: 16/482,306

(22) PCT Filed: Jan. 31, 2018

(86) PCT No.: PCT/EP2018/052446
§ 371 (c)(1),
(2) Date: Jul. 31, 2019

(87) PCT Pub. No.: WO2018/141818
PCT Pub. Date: Aug. 9, 2018

(65) Prior Publication Data
US 2020/0002781 A1 Jan. 2, 2020

(30) Foreign Application Priority Data
Jan. 31, 2017 (GB) ..... 1701597

(51) Int. Cl.
*C21D 9/56* (2006.01)

(52) U.S. Cl.
CPC ..... *C21D 9/565* (2013.01); *C21D 9/563* (2013.01)

(58) Field of Classification Search
CPC ..... C21D 9/565; C21D 9/563
See application file for complete search history.

(56) References Cited

U.S. PATENT DOCUMENTS 4,437,901 A * 3/1984 Gentry ..... C21D 9/56 266/104
5,554,235 A 9/1996 Noe et al.
2006/0118242 A1* 6/2006 Herbert ..... D06M 10/025 156/345.31

(Continued)

FOREIGN PATENT DOCUMENTS

CN 202 176 716 3/2012
CN 102 828 195 12/2012
CN 102828195 A * 12/2012

(Continued)

OTHER PUBLICATIONS

Machine Translation of CN-102828195-A (Year: 2012).*

(Continued)

*Primary Examiner* — Keith Walker
*Assistant Examiner* — Ryan L Heckman
(74) *Attorney, Agent, or Firm* — Gudrun E. Huckett

(57) ABSTRACT

A heat treatment device for a thermal treatment of a workpiece is provided with a housing that houses a chamber for accommodating the workpiece for the thermal treatment. A first roller supports the workpiece and moves the workpiece in a moving direction. A first brush seal is provided, wherein the first roller and the first brush seal are arranged relative to each other such that a first side of the workpiece contacts the first roller and a second side of the workpiece that is opposed to the first side contacts the first brush seal such that the first roller and the first brush seal then seal at least a first section of the chamber from a second section of the chamber.

19 Claims, 4 Drawing Sheets

(56) References Cited

U.S. PATENT DOCUMENTS

| | | | | |
|---|---|---|---|---|
| 2010/0308541 | A1 | 12/2010 | Kuemmel et al. | |
| 2012/0305547 | A1* | 12/2012 | Fukutani | H05B 6/10 219/660 |

FOREIGN PATENT DOCUMENTS

| | | | | |
|---|---|---|---|---|
| CN | 204 052 401 | | | 12/2014 |
| JP | S5729522 | A | * | 7/1980 |
| JP | S57 29522 | | | 2/1982 |
| JP | S57-152427 | | | 9/1982 |
| JP | H08-291339 | | | 11/1996 |
| JP | H11-80842 | | | 3/1999 |
| JP | 2001 032018 | | | 2/2001 |
| JP | 2011 202250 | | | 10/2011 |
| JP | 2011202250 | A | * | 10/2011 |
| RU | 2138341 | | | 5/1997 |
| RU | 296445 | | | 12/1997 |
| RU | 2409683 | | | 12/2010 |
| SU | 1337428 | A1 | * | 12/1985 |
| SU | 1 337 428 | | | 9/1987 |

OTHER PUBLICATIONS

Machine Translation of SU-1337428-A1 (Year: 1985).*
Machine Translation of JP-2011202250-A (Year: 2011).*
Machine Translation of JPS5729522A (Year: 1980).*

* cited by examiner

SEALING DEVICE FOR A CONTINUOUS FURNACE

BACKGROUND OF THE INVENTION

Field of Invention

The present invention relates to a heat treatment device for thermal treatment of a workpiece, in particular a strip-shaped workpiece. Furthermore, the present invention relates to a method of operating the heat treatment device for thermal treatment of a workpiece.

Prior Art

In industrial furnaces, in particular in continuous annealing furnaces and continuous strip processing lines, respectively, the atmosphere within the chamber is generated by ambient air or by specific process gases which is beneficial for a heat treatment of workpieces, in particular made of metal. Furthermore, due to a process gas atmosphere made of hazardous process gases or due to chemical reactions within the furnace atmosphere, the chamber has to be sealed between adjacent section of the chamber or between the inner volume of the chamber and the environment. Exceeding an explosive concentration of e.g. hydrogen, carbon monoxide, or oxygen can cause severe accidents.

In continuous processing lines strips material is supported by rollers within the chamber. In continuous metal strip processing lines it is commonly used to install pairs of two opposing rollers on each side of the steel strip to be sealed to seal the, e.g. high hydrogen containing, annealing chamber over the ambient (air). The rollers are either uncoated or coated. However, if opposing rollers are misaligned in particular along a movement direction of the metal strip, the system is no longer hermetically sealed. Furthermore, under hot furnace temperature, a clamping of the metal strip between the rollers is not appropriate, because the metal strip would be deformed.

SUMMARY OF THE INVENTION

It may be an object of the present invention to provide a heat treatment device with a proper sealing arrangement.

This object is solved by a heat treatment device for thermal treatment of the workpiece and by a method of operating a heat treatment device for thermal treatment of the workpiece according to the subject matter of the independent claims.

According to a first aspect of the present invention, a heat treatment device for thermal treatment (e.g. heating or cooling) of a workpiece, in particular a strip shaped workpiece is presented. The heat treatment device comprises a housing which houses a (heating or cooling) chamber in which the workpiece is arrangeable for providing a thermal treatment, a first roller and a first brush seal. The workpiece is supportable by the first roller and is movable along a moving direction. The first roller and the first brush seal are arranged with respect to each other in such a way that a first side of the workpiece contacts the first roller element and a second side of the workpiece, which second side is opposed to the first side, contacts the first brush seal such that at least a first section of the chamber is sealed by the first roller and the first brush seal from a second section of the chamber.

A further aspect of the present invention is a method of operating above described heat treatment device for thermal treatment of a workpiece, in particular a strip shaped workpiece. According to the method, the workpiece is arranged in the chamber for providing a thermal treatment. The workpiece is moved along a moving direction between the first section for providing a thermal treatment and the second section for providing a thermal treatment.

The heat treatment device according to the present invention may be a furnace, e.g. a batch type furnace or a continuous furnace. In the chamber, temperatures of about 100° C. to 1200° C. may be provided. Hence, the heat treatment device according to the present invention may be used as an annealing furnace or a high temperature furnace. Furthermore, the heat treatment device may be used as a cooling device for workpieces leaving a foregoing furnace device. In an exemplary embodiment, the heat treatment device may be used as a sealing device, which is installed between a furnace and an environment. Hence, the chamber may form a pre-chamber of a further downstream located furnace.

The heat treated workpiece may be for example made of metal and a metal compound, respectively. In particular, the workpiece may be a strip-shaped workpiece, wherein the strip-shaped workpiece is guided through the heat treatment device in a continuous forward movement or a sequential forward movement along a moving direction of the workpiece.

The moving direction of the workpiece defines a direction of the workpiece between an entrance of the chamber to an exit of the chamber. The moving direction within the chamber may vary. As described below, a respective roller may deflect the workpiece during running through the chamber.

The rollers according to the present invention form in particular a support for the workpiece. This means, that the workpiece is carried and/or deflected by the respective roller. In particular, the first side of the workpiece contacts the outer surface of the roller. The rollers may be hollow formed rollers or may be massive formed rollers. The rollers may be formed of ceramic, plastic or metal material. Specifically, the rollers may be coated by a heat resistant material, e.g. by Teflon, tungsten carbide (WC), vanadium carbide (VC) and/or may be covered by composites, e.g. OCMC (oxide ceramic matrix composite).

In an exemplary embodiment of the present invention, the rollers may be heated or cooled. For example, the rollers may be temperature controlled, such that an outer surface of the rollers may be temperature controlled and may have a temperature range between 150° C. and 600° C. or more. The rollers may have a diameter of 50 mm to 100 mm. However, rollers with diameters larger than 100 mm are possible as well.

The rollers rotate around respective rotating axis. In an exemplary embodiment, one of the rollers are drivable by a driving unit in order to drive the workpiece through the chamber. In the further exemplary embodiment of the present invention, the rotating axis of two adjacent rollers are spaced apart along a moving direction of the workpiece and additionally spaced apart along a direction orthogonal to the moving direction of the workpiece through the heat treatment device. In other words, the rotating axis of two adjacent rollers may be spaced apart along a vertical direction and/or a horizontal direction. In particular, the rotating axis of two adjacent rollers are parallel with respect to each other. The roller may be fixed to and sealed against the housing for example by a second brush seal or preferable by a pair of brush seals as described below. In-between the pair of second brush seals an intermediate section having an atmosphere, e.g. $N_2$, may be defined.

The "first" brush seals according to the present invention comprises brushes which contact the second side of the workpiece. The brushes of the first brush seals are arranged with respect to the workpiece opposed to the respective roller. Hence, the brushes of the first brush contact the second side of the workpiece and the respective opposed roller contacts the first side of the workpiece. Thereby, a sealing arrangement is provided, because a process gas flow from one side of the first brush to the other side of the first brush (i.e. along the moving direction) is reduced or prevented.

The brushes are flexible, in particular elastically deformable, and are made for example of high temperature resistant material. The brushes may be made out of different materials from plastics up to high temperature alloys as the operation condition require. For example, the brushes may be formed of corrosion and high temperature resistant materials, e.g. CrNi (chromium nickel) alloys and Ni based alloys (INOX) (materials with steel alloys) with an e.g. a minimum of 10.5% chromium content by mass. The sealing brushes may be filled brushes, e.g. having a steel fill or a plastic fill. In order to provide a beneficial flexibility and strength of the sealing brushes, the length of the bristles between the workpiece and the brush holder of the sealing brush may be between 5 mm and 100 mm (millimeters) by having a diameter of 0.07 mm to 0.1 mm (millimeters).

Specifically, according to an exemplary embodiment of the present invention, the first brush seal is arranged with respect to the roller in such a way, that without the presence of the workpiece, the brushes of the brush seal contact the surface of the first roller. The workpiece is moved between the first brush seals and the respective roller so that the workpiece bends the brushes of the brush seal away, so that the brushes of the brush seal contact the second side of the workpiece while the workpiece is supported by its first side onto the first roller. Hence, the sections are sealed by the respective roller/brush seal arrangement. The workpiece can be moved the sections are always hermetically sealed from each other as the flexible bristles (brushes) of the first brush seal are adjusted automatically by its flexible properties.

The sealing arrangement defined by a roller and a respective first brush seal seals and thereby separates a first section of the chamber from a second section of the chamber. Inside a respective section of the chamber process parameters of the atmosphere can be predefined. For example, in the first section of the chamber, an atmosphere having a first gas composition, a first temperature and/or a first pressure is predefined. Accordingly, in a second section of the chamber, an atmosphere having a second gas composition, a second temperature and/or a second pressure can be defined. Hence, by the sealing arrangement consisting of a respective roller and brush seal combination, two sections of the chamber may be separated and sealed.

In an exemplary embodiment, the second section is defined as the ambient section of the heat treatment device and the first section is within the chamber of the heat treatment device. In this embodiment, the first roller and the respective first brush seal forms an entrance or an exit of the furnace housing. However, in a further exemplary embodiment, the first and second section define inner sections of the chamber which are separated by a respective first roller/brush seal arrangement. For example, the chamber is separated in different sections. One section may be a heating or cooling section of the chamber, in which the workpiece is thermally treated (i.e. heated or cooled). Furthermore, another section may be a sealing chamber for providing a buffer zone between the section for thermal treatment and another section (e.g. the environment). For example, in the first section, an inert gas atmosphere made of nitrogen $N_2$ can be provided, whereas in the second section, a high concentrated hydrogen $H_2$ atmosphere may be provided. Furthermore, between both sections different process pressures with a pressure difference between 0.1 mbar to 20 mbar may be adjusted. By providing a pressure difference between two adjacent sections, a desired process gas flow caused by sealing leakage may be provided, so that an uncontrolled exit of hazardous process gas may be prevented. Furthermore, while in the first section the first temperature may be adjusted, the second section may comprise a different higher or lower temperature with respect to the temperature of the atmosphere and the first section.

By the approach of the present invention, a sealing arrangement comprising a first roller on the one side of a workpiece to be heated and a respective brush seal on another side of the workpiece to be heated is provided. The brushes of the first brush seal touches e.g. the roller surface and/or the workpiece. The workpiece passes through the bristles of the first brush seal and deflects the bristles above the workpiece surface. The remaining bristles of the brush may be in contact with the surface of the roller. Hence, the workpiece is always (hermetically) sealed over the environment and sections of the chamber. Each section may have different process atmospheres. The flexible bristles of the sealing brush are deflected across the workpiece width. Workpieces having different width (i.e. having an extension along the rotating axis of the roller) may be applied without losing a sealing quality of the heat treatment device, because the workpiece bends away the brushes of the first brush seal, whereas the brushes of the first brush seal which are not bent away by the workpiece may be still in contact with the surface of the respective roller. Hence, a sealing along the whole length along the rotating axis of the respective roller may be provided, independent of the width of the workpiece (i.e. the width of the workpiece along the rotating axis if the roller).

According to an embodiment of the invention, the first roller is drivable by a driving unit such that the first roller drives the workpiece along the moving direction.

According to an embodiment of the invention, the first roller is adjustable with respect to the first brush seal such that a distance between the first roller and the first brush seal is adjustable. The rotating axis of the roller may be adjusted by an adjusting device, for example having hydraulic or pneumatic cylinders or by linear precision drives. At the same time the first brush seal on the opposite side of the workpiece can also be adjusted, as described further below, in the same way. Hence, the rollers can be adjusted e.g. perpendicular to the strip pass line (moving direction) in the direction to or away the workpiece e.g. to deflect the workpiece as it may be required (position controlled).

According to an embodiment of the invention, the first roller is adjustable along the moving direction. The rotating axis of the roller may be adjusted by the adjusting device. At the same time the first brush seal on the opposite side of the workpiece can also be adjusted along the moving direction, as described further below, in the same way. Hence, the rollers can be adjusted e.g. parallel to the strip pass line (moving direction) in the direction to or away the workpiece e.g. to deflect the workpiece as it may be required (position controlled).

According to an embodiment of the invention, the first brush seal is adjustable with respect to the first roller such that a distance between the first roller and the first brush seal adjustable. In an exemplary embodiment, the complete first brush seal may be adjustable in the direction to the first roller. Specifically, the first brush seal is adjustable along the radial direction of the first roller. Alternatively, the brushes of the first brush seal may extend and may be moved out of a brush holder as described below. For example, if installing a new metal strip (workpiece), the first brush seal may be moved away from the first roller. A so called needle formed by an I-profile supporting the metal strip may then be guided into the housing till the strip is completely supported by the rollers.

According to an embodiment of the invention, the first brush seal is pretensioned by a pretensioning device with respect to the first roller such that the pretensioning device presses the brush seal in direction to the first roller. The pretensioning device may comprise for example a spring, in particular a tensioning spring or a compression spring. Hence, it is ensured, that the brushes of the first brush seal are permanently pressed either against the first roller or the interposed workpiece.

According to an embodiment of the invention, the first brush seal is adjustable along the moving direction and/or the first brush seal is adjustable along a direction parallel to an axial direction of a rotary axis of the first roller.

According to an embodiment of the invention, the first brush seal comprises brushes and a brush holder for holding the brushes. The brushes may be clamped or glued within the brush holder, wherein an extending part of the brushes extends from an end of the brush holder in the direction to the first roller. Depending on the length of the brushes between the end of the brush holder and the first roller surface and the workpiece, respectively, the flexible and elastic character of the brushes is adjustable.

According to an embodiment of the invention, the first brush seal further comprises a brush adjusting device, wherein the brush adjusting device is configured for moving the brushes with respect to the brush holder such that a length of the brushes between the (end of the) brush holder and the first roller is adjustable. The adjusting device may comprise for example a movable piston to which the brushes are fixed. The movable piston may be driven along the direction to or away from the first roller. The adjusting device and the movable piston, respectively, may be drivable in a pneumatic, hydraulic or electrical manner.

According to an embodiment of the invention, the heat treatment device further comprises a dividing wall dividing partially the first section from the second section, wherein the dividing wall extends from the housing into the chamber. The first brush seal is fixed to the dividing wall. The dividing wall may comprise a free end to which the first brush seal is fixed to. Hence, between the first brush seal and the furnace housing, a separation of the respective section by the dividing wall is provided.

According to a further exemplary embodiment, the heat treatment device resp. the furnace further comprises a second brush seal, wherein the second brush seal contacts the first roller such that the first section of the chamber is further sealed by the first roller and the second brush seal from the second section of the chamber. By the second brush seal, the volume between the first roller and the housing may be sealed. In other words, the second brush seal provides a sealing with the first roller at a region where no workpiece is guided through. At the same time, the first roller may be rotated with respect to the second brush seal. The second brush seal may have a similar design and may be made of a similar material as the above described first brush seal.

According to a further exemplary embodiment, the heat treatment device further comprises a further second brush seal spaced apart from the second brush seal. The further second brush seal contacts the first roller such that the first section of the chamber is further sealed from the second section of the chamber by the first roller and the further second brush seal. The further second brush seal may have a similar design and may be made from a similar material as the second brush seal. The second brush seal and the further second brush seal are spaced apart from each other in such a way, that the respective brushes of the second brush seal and the second brush seal contacts the surface of the respective roller at different locations in circumferential direction of the roller. They preferably do not touch each other and leave a partial surface of the workpiece free between them. Between the second brush seal and the further second brush seal an intermediate section e.g. having a pre-determined atmosphere may be generated.

According to a further exemplary embodiment, the heat treatment device further comprises a third brush seal. The third brush seal is arranged spaced apart along the moving direction from the first brush seal. The first roller and the third brush seal are arranged with respect to each other in such a way that the first side of the workpiece contacts the first roller element and the second side of the workpiece contacts the third brush seal. The third brush seal may have a similar design and may be made from a similar material as the first brush seal. The first brush seal and the third brush seal are spaced apart from each other in such a way, that the respective brushes of the first brush seal and the third brush seal contacts the workpiece and/or the surface of the first roller at different locations. Here, too, the first and third brush seals preferably do not touch each other on the surface of the workpiece but leave a partial surface of the workpiece free between them. Between the first brush seal and the second brush seal an intermediate section e.g. having a predetermined atmosphere may be generated.

According to a further exemplary embodiment, the heat treatment device further comprises a second roller spaced apart from the first roller along the moving direction. The workpiece is supportable by the second roller. The heat treatment device further comprises a further first brush seal, wherein the second roller and the further first brush seal are arranged with respect to each other in such a way that a further first side of the workpiece contacts the second roller and a further second side of the workpiece, which further second side is opposed to the further first side, contacts the further first brush seal such that at least the first section or a further first section of the chamber is sealed by the second roller and the further first brush seal from a third section of the chamber. By the present exemplary embodiment it is shown, that in a heat treatment device according to the present invention a plurality of above described roller/brush seal arrangements can be installed.

It has to be noted that embodiments of the invention have been described with reference to different subject matters. In particular, some embodiments have been described with reference to apparatus type claims whereas other embodiments have been described with reference to method type claims. However, a person skilled in the art will gather from the above and the following description that, unless other notified, in addition to any combination of features belonging to one type of subject matter also any combination between features relating to different subject matters, in particular between features of the apparatus type claims and features of the method type claims is considered as to be disclosed with this application.

BRIEF DESCRIPTION OF THE DRAWINGS

The aspects defined above and further aspects of the present invention are apparent from the examples of embodiment to be described hereinafter and are explained with reference to the examples of embodiment. The invention will be described in more detail hereinafter with reference to examples of embodiment but to which the invention is not limited.

DETAILED DESCRIPTION OF EXEMPLARY EMBODIMENTS

Figure 1:
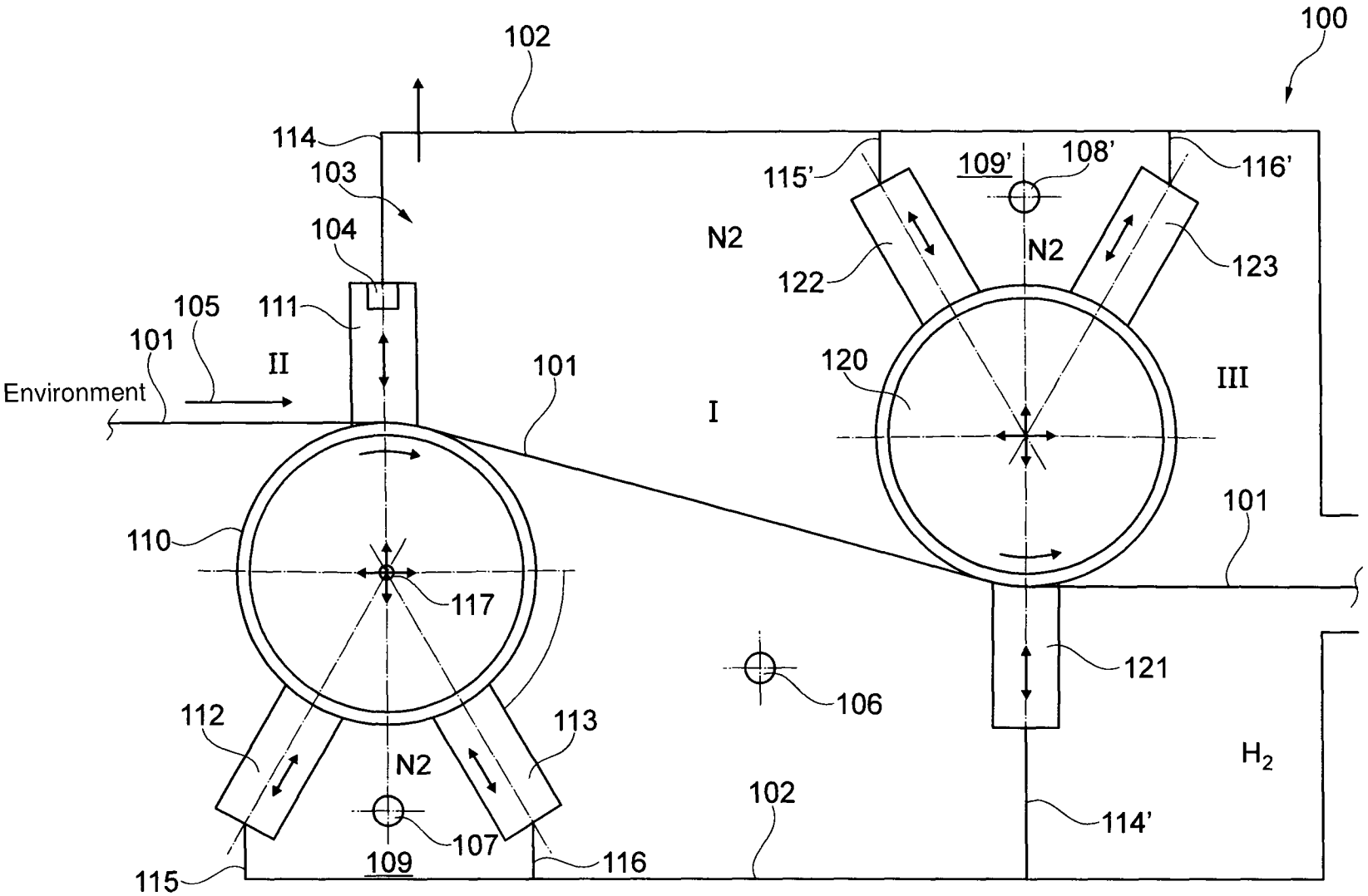
FIG. 1 shows a schematic view of a heat treatment device, in particular a sealing device, comprising two rollers according to an exemplary embodiment of the present invention.

The illustrations in the drawings are schematic. It is noted that in different figures similar or identical elements are provided with the same reference signs.

FIG. 1 shows a heat treatment device 100 according to an exemplary embodiment of the present invention. The heat treatment device 100 may be a sealing device which is installed at an entrance of a furnace (e.g. shown in FIG. 4). The heat treatment device 100 comprises two rollers 110, 120 according to an exemplary embodiment of the present invention. The heat treatment device 100 is for thermal treatment of a workpiece 101, in particular a strip shaped workpiece 101. The heat treatment device 100 comprises a housing 102 which houses a chamber 103 in which the workpiece 101 is arrangeable for providing a thermal treatment. The workpiece 101 is supportable by a first roller 110 and is movable along a moving direction 105. The first roller 110 and a first brush seal 111 are arranged with respect to each other in such a way that a first side of the workpiece 101 contacts the first roller 110 element and a second side of the workpiece 101, which second side is opposed to the first side, contacts the first brush seal 111 such that at least a first section I (e.g. a first sealing chamber) of the chamber 103 is sealed by the first roller 110 and the first brush seal 111 from a second section II (e.g. a second sealing chamber of the chamber 103).

The heat treatment device further comprises the second roller 120 spaced apart from the first roller 110 along the moving direction 105. The workpiece 101 is supportable by the second roller 120. The heat treatment device 100 further comprises a further first brush seal 121, wherein the second roller 120 and the further first brush seal 121 are arranged with respect to each other in such a way that the second side of the workpiece 101 contacts the second roller 120 and the first side of the workpiece 101 contacts the further first brush seal 121 such that the first section I is sealed by the second roller 120 and the further first brush seal 121 from a third section III (e.g. a third sealing chamber) of the chamber 103.

The heat treatment device 100 in the exemplary embodiment in FIG. 1 is a pre sealing chamber, which is arranged with respect to an entrance of a furnace, for example. In the chamber 103, temperatures of about 100° C. to 1200° C. may be provided.

The heat treated workpiece 101 is in FIG. 1 for example a metal strip-shaped workpiece 101. The strip-shaped workpiece 101 is guided through the heat treatment device 100 in a continuous forward movement or a sequential forward movement along a moving direction 105 of the workpiece 101.

The rollers 110, 120 form a support for the workpiece 101. The workpiece 101 is carried by the first roller 110 and/or deflected by the second roller 120. In particular, the first side of the workpiece 101 contacts the outer surface of the respective roller 110, 120. Herein the rollers 110, 120 are hollow formed rollers.

The rollers 110, 120 rotate around respective rotating axis 117. In an exemplary embodiment, one of the rollers 110, 120 is driveable by a driving unit in order to drive the workpiece 101 through the chamber 103. The rotating axis 117 of the two adjacent rollers 110, 120 are spaced apart along a vertical direction and a horizontal direction. The rollers 110, 120 are fixed to and sealed against the housing 102 by one or possibly two second brush seals 112, 113, 122, 123. Between an axial end of a roller 110, 120, an axial sealing between the axial end and the housing 102 may be arranged.

The first brush seal 111 and the further first brush seal 121 comprise brushes which contact the second side of the workpiece 101. The first brush seals 111, 121 are arranged with respect to the workpiece 101 opposed to the respective roller 110, 120. Hence, the brushes of the first brush seals 111, 121 contact the second side of the workpiece 101 and the respective opposed roller 110, 120 contacts the first side of the workpiece 101. Thereby, a sealing arrangement is provided, because a process gas flow from one side of the first brush 111, 121 to the other side of the first brush 111, 121 (i.e. along the moving direction 105) is reduced or prevented.

The brushes of the first brush seals 111, 121 are flexible, in particular elastically deformable, and are made for example of high temperature resistant material.

The first brush seals 111, 121 are arranged with respect to the roller in such a way, that without the presence of the workpiece 101, the brushes of the first brush seals 111, 121 contact the surface of the first and second roller 110, 120, respectively. The workpiece 101 is moved in operation of the heat treatment device 100 between the first brush seals 111, 121 and the respective roller 110, 120 so that the workpiece 101 bends the brushes of the respective the first brush seals 111, 121 away, so that the brushes contact the second side of the workpiece 101 while the workpiece 101 is supported by its first side onto the respective roller 110, 120. Hence, the sections I, II are sealed by the respective roller 110, 120/first brush seal 111, 121 arrangement. The workpiece 101 can be moved and the sections I, II, III are always hermetically sealed from each other as the flexible bristles (brushes) of the first brush seals 111, 121 are adjusted automatically by its flexible properties.

Summarizing, a sealing arrangement is defined by a respective roller 110, 120 and a respective first brush seal 111, 121. A sealing arrangement thereby separates the first section I of the chamber 103 from a second section II of the chamber 103. Inside a respective section I, II, III of the chamber 103, predefined process parameters of the atmosphere inside the respective section I, II, III can be predefined. For example, in the first section I of the chamber, an atmosphere having a first gas composition, such as Nitrogen $N_2$ having a first pressure is generated. The first gas atmosphere may be injected by a first inlet 106. Accordingly, in the second section II of the chamber 103, an atmosphere having a second gas composition, such as the ambient air having ambient temperature can be defined. In the third section III of the chamber 103, an atmosphere having a third gas composition, such as the hydrogen H2 having a second temperature can be defined. The chamber 103 may have also a controllable outlet, such that a desired amount of gas may be exhausted in an controllable manner.

In an exemplary embodiment shown in FIG. 1, the second section II is defined as the ambient section of the heat treatment device 100 and the first section I is within the chamber 103 of the heat treatment device 100. In this embodiment, the first roller 110 and the respective first brush seal 111 forms an entrance or an exit of the housing 102. Furthermore, the first and third section I, III define inner sections of the chamber which are separated by a respective second roller 120/further first brush seal 121 arrangement. For example, in the first section I, an inert gas atmosphere made of nitrogen $N_2$ can be provided, whereas in the third section III, a high concentrated hydrogen $H_2$ atmosphere may be provided. Furthermore, between both sections I, III different process pressures with a pressure difference between 0.1 mbar to 20 mbar may be adjusted. By providing a pressure difference between two adjacent sections I, III, a desired process gas flow caused by sealing leakage may be provided, so that an uncontrolled exit of hazardous process gas may be prevented. Furthermore, while in the first section I the first temperature may be adjusted, the third section III may comprise a different higher or lower temperature with respect to the temperature of the atmosphere and the first section I.

In operation, the brushes of the first brush seals 111, 121 touches e.g. the roller surface of a respective roller 110, 120 and/or the workpiece 101. The workpiece 101 passes through interface between the bristles of the first brush seals 111, 121 and deflects the bristles which then contacts the workpiece surface. The flexible bristles of the first brush seals 111, 121 are deflected across the workpiece width. The remaining bristles of the first brush seals 111, 121, which were not bent away by the workpiece 101, are still in contact with the surface of the respective roller 110, 120. Hence, in each section the workpiece 101 is (hermetically) sealed over the environment II resp. the other sections I, III of the chamber 103.

The first roller 110 and/or the second roller 120 is adjustable with respect to the respective first brush seal 111, 121 such that a distance between the respective roller 110, 120 and the respective first brush seal 111, 121 is adjustable. The rollers 110, 120 can be adjusted e.g. perpendicular to the strip pass line (moving direction 105) in the direction to or away the workpiece 101 e.g. to deflect the workpiece 101 as it may be required (position controlled).

Furthermore, the first brush seals 111, 121 are adjustable with respect to the first roller 110 and the second roller 120, respectively, such that a distance between the respective roller 110, 120 and the respective first brush seal 111, 121 adjustable. In an exemplary embodiment, the complete first brush seals 111, 121 may be adjustable in the direction to the respective rollers 110, 120.

The first brush seal 111, 121 is pretensioned by a pretensioning device with respect to the respective rollers 110, 120 such that the pretensioning device presses the first brush seal 111, 121 in direction to the respective rollers 110, 120.

As can be taken from FIG. 1, the heat treatment device 100 further comprises dividing walls 114, 115, 116. The respective dividing walls 114, 115, 116 divides two adjacent sections I, III. The dividing walls 114, 115, 116 extend from the housing 102 into the chamber 103. The first brush seal 111 is fixed to the dividing wall 114. The second brush seal 112 and the further second brush seal 113 are fixed to a respective further dividing walls 115, 116. The dividing walls 114, 115, 116 may comprise a free end to which the respective brush seals 111, 112, 113 are fixed to. Thereby, e.g. between the first brush seal 111 and the housing 102, a separation of the respective sections I, II by the dividing wall 114 is provided. The respective further brush seals 121, 122, 123 are fixed to respective dividing walls 114', 115', 116'.

The second brush seals 112 contacts the first roller 110 such that the first section I of the chamber 103 is further sealed by the first roller 110 and the second brush seal 112 from the second section II of the chamber 102. Thus, by the second brush seal 112, the volume between the first roller 110 and the housing 102 may be sealed. In other words, the second brush seal 112 provides a sealing with the first roller 110 at a region where no workpiece 101 is guided through. At the same time, the first roller 110 may be rotated with respect to the second brush seal 112. The second brush seal 112 may have a similar design and may be made of a similar material as the above described first brush seal 111.

Additionally, a further second brush seal 113 is arranged spaced apart from the second brush seal 112. The further second brush seal 113 contacts the first roller 110 such that the first section I of the chamber 103 is further sealed from the second section II of the chamber 103 by the first roller 110 and the further second brush seal 113. The further second brush seal 113 may have a similar design and may be made from corresponding material as the second brush seal 112. The second brush seal 112 and the further second brush seal 113 are spaced apart from each other in such a way, that the respective brushes of the second brush seal 112 and the second brush seal 113 contacts the surface of the respective roller 110 at different locations in circumferential direction of the roller 110. Between the second brush seal 112 and the further second brush seal 113 an intermediate section 109 e.g. having a pre-determined atmosphere (for example nitrogen $N_2$) may be generated by injecting the gas through a second inlet 107.

Additionally, a further second brush seal 123 is arranged spaced apart from the second brush seal 122. The second brush seals 122, 123 contact the second roller 120 such that the first section I of the chamber 103 is further sealed from the third section III of the chamber 103. The second brush seal 122 and the further second brush seal 123 are spaced apart from each other in such a way, that the respective brushes of the second brush seal 122 and the second brush seal 123 contact the surface of the respective roller 120 at different locations in circumferential direction of the roller 120. Between the second brush seal 122 and the further second brush seal 123 an intermediate section 109' e.g. having a pre-determined atmosphere (for example nitrogen $N_2$) may be generated by injecting the gas through a third inlet 108.

Figure 2:
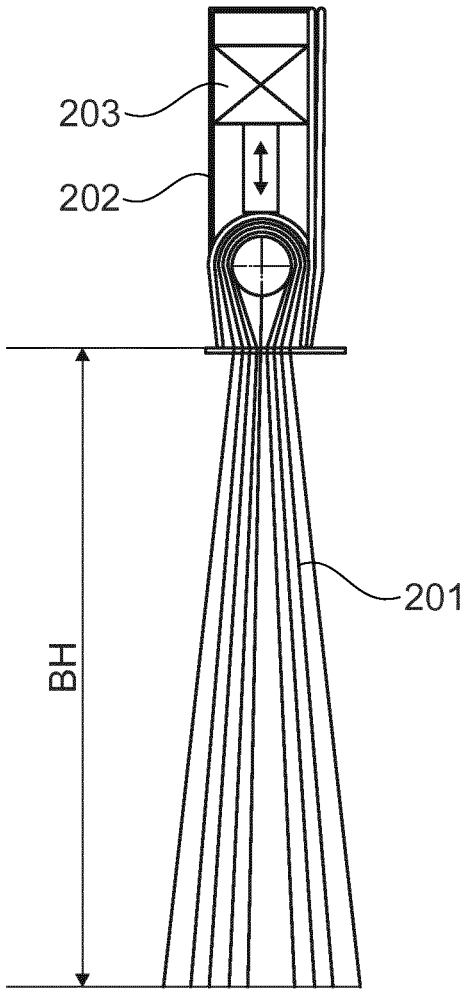
FIG. 2 shows a schematic view of a brush seal according to an exemplary embodiment of the present invention.

FIG. 2 shows a more detailed view of a brush seal 111, 112, 121, 122 according to an exemplary embodiment of the present invention. For example, the respective brush seal comprises brushes 201 and a brush holder 202 for holding the brushes resp. bristles 201. The brushes 201 may be clamped or glued within the brush holder 202, wherein an extending part BH of the brushes extends from an end of the brush holder 202 in the direction to e.g. the first roller 110. Depending on the length of the brushes 201 between the end of the brush holder 202 and the roller surface and the workpiece 101, respectively, the flexible and elastic character of the brushes 201 is adjustable.

The brush seal further comprises a brush adjusting device 203, wherein the brush adjusting device 203 is configured for moving the brushes 201 with respect to the brush holder 202 such that a length of the brushes 201 (e.g. length BH)

between the (end of the) brush holder 202 and the respective roller is adjustable. However, it is also possible to arrange the brush holder 202 together with the brushes 201 to the brush adjusting device 203, so that the brush holder 202 is moved with respect to the brush adjusting device 203.

Figure 3:
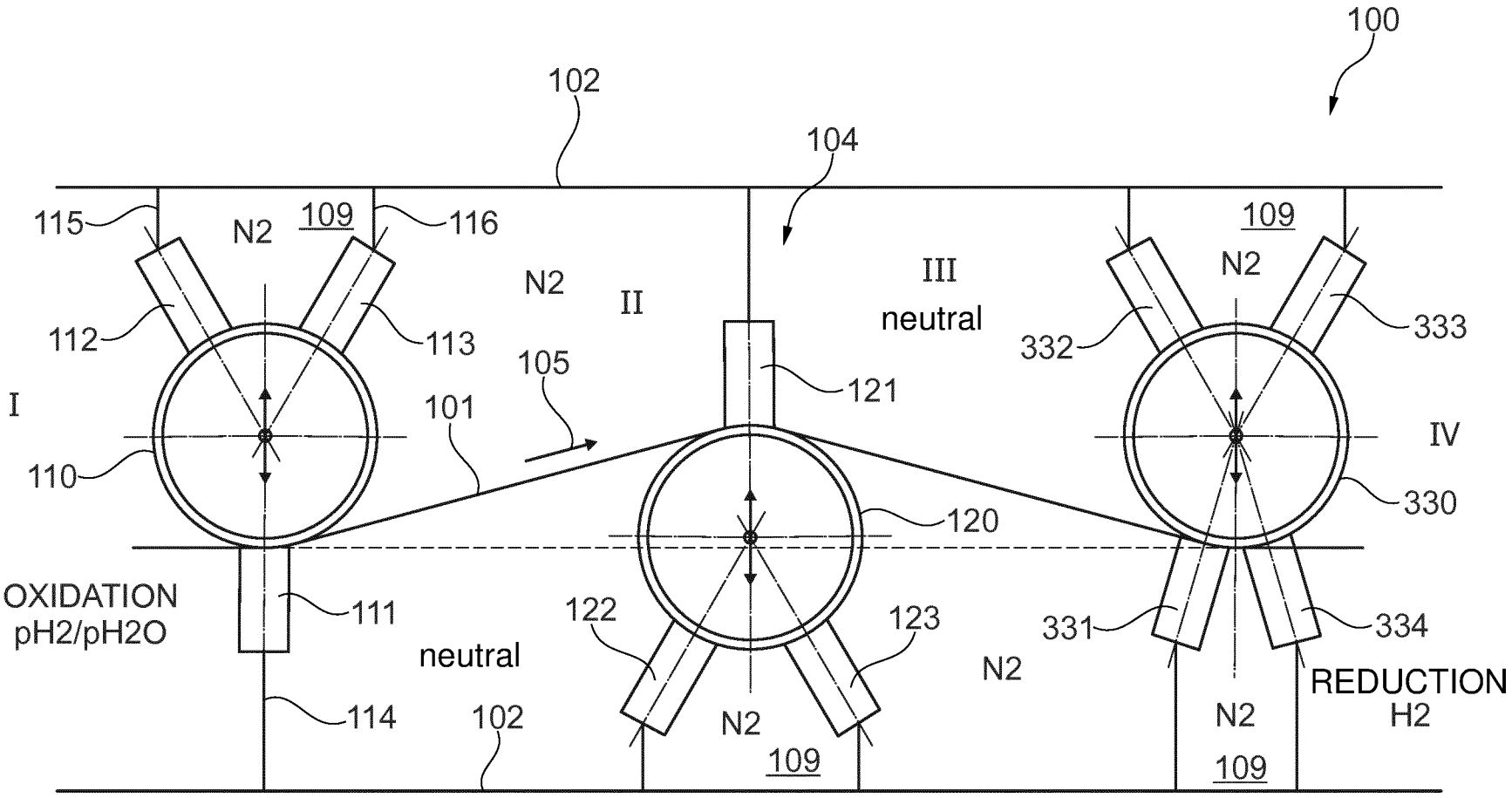
FIG. 3 shows a schematic view of a heat treatment device comprising three rollers and a third brush seal according to an exemplary embodiment of the present invention.

FIG. 3 shows a schematic view of a heat treatment device comprising three rollers 110, 120, 130 and a third brush seal 334 according to a further exemplary embodiment of the present invention. The exemplary embodiment shown in FIG. 3 comprises similar first and second brush seal/roller arrangement as shown in FIG. 1. Additionally, the exemplary embodiment comprises a third brush seal/roller arrangement.

The heat treatment device 100 further comprises the third roller 330 spaced apart from the second roller 120 along the moving direction 105. The workpiece 101 is supportable by the third roller 330. The heat treatment device 100 further comprises a further first brush seal 331, wherein the third roller 330 and the further first brush seal 331 are arranged with respect to each other in such a way that the second side of the workpiece 101 contacts the third roller 330 and the first side of the workpiece 101 contacts the further first brush seal 331 such that the shown third section III is sealed by the third roller 330 and the further first brush seal 331 from a fourth section IV of the chamber 103.

The heat treatment device 100 further comprises a third brush seal 334. The third brush seal 334 is arranged spaced apart along the moving direction 105 from the further first brush seal 331. The third roller 330 and the third brush seal 334 are arranged with respect to each other in such a way that the second side of the workpiece 100 contacts the third roller 330 and the first side of the workpiece 100 contacts the third brush seal 334. The third brush seal 334 may have a similar design and may be made from corresponding material as the first brush seal 111. The further first brush seal 331 and the third brush seal 334 are spaced apart from each other in such a way, that the respective brushes of the first brush seal 331 and the third brush seal 334 contacts the workpiece 101 and/or the surface of the third roller 330 at different locations. Between the further first brush seal 331 and the third brush seal 334 an intermediate section 109 e.g. having a predetermined atmosphere, such as Nitrogen $N_2$ may be generated. Furthermore, a respective second brush seal 332 and a further second brush seal 333 are arranged and contact a surface of the third roller 330.

According to the embodiment shown in FIG. 3, the first roller 110/first brush seal 111 arrangement seals the first section I from the second section II of the chamber 103. The first section I may have a Hydrogen/Water ($H_2/H_2O$) atmosphere for oxidation purposes of the workpiece 101. The second roller 120/further first brush seal 121 arrangement seals the second section II from the third section III of the chamber 103. The second and third section II, III may have an inert gas atmosphere, e.g. filled with nitrogen $N_2$. The third roller 130/further brush seal 331, 334 arrangement seals the third section III from the fourth section IV of the chamber 103. The fourth section IV may have a hydrogen $H_2$ atmosphere, e.g. for reduction purposes of the workpiece 101.

Figure 4:
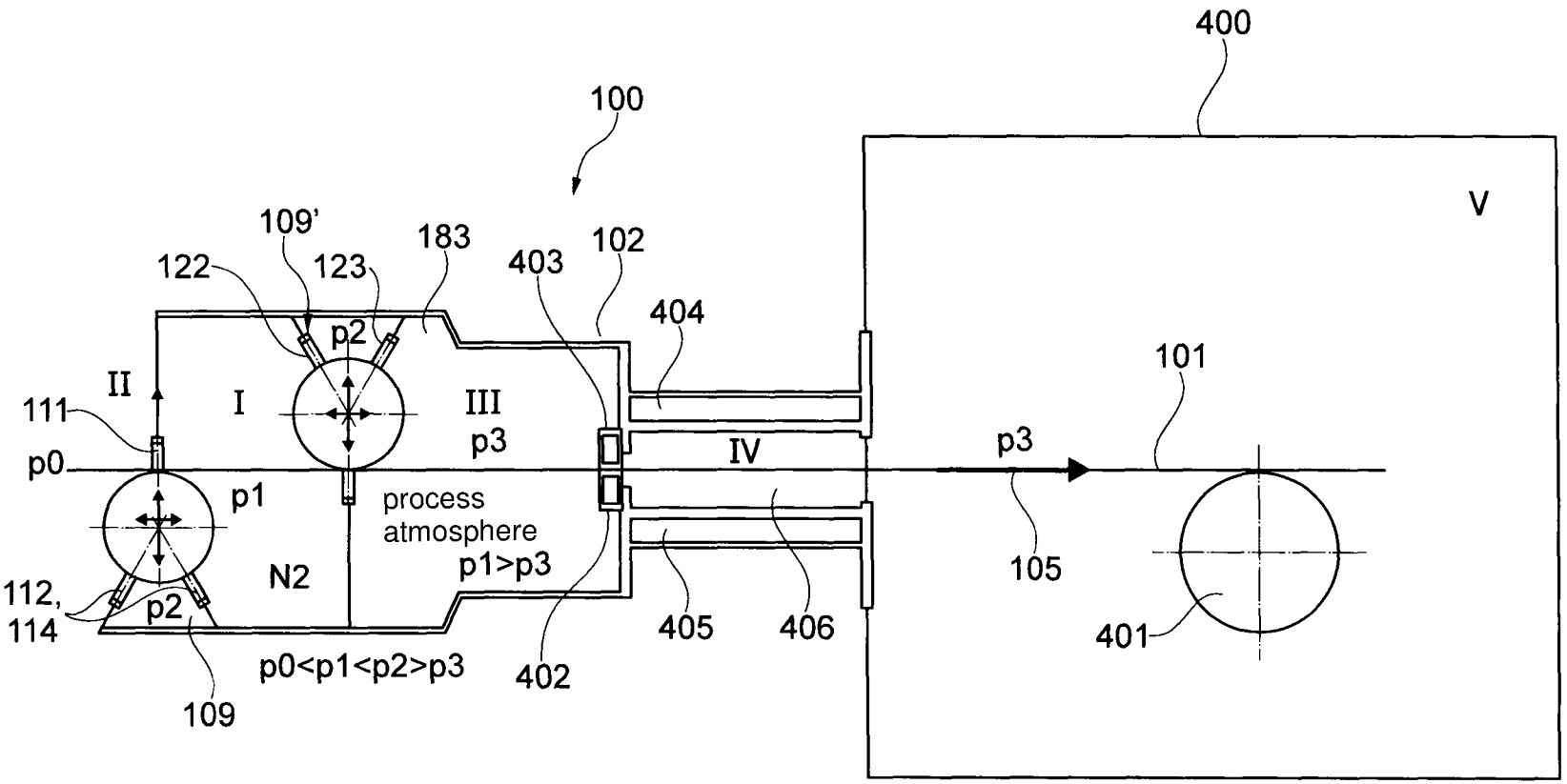
FIG. 4 shows a heat treatment system comprising a heat treatment zone coupled to a housing forming a sealing unit as shown in FIG. 1, according to an exemplary embodiment of the invention.

FIG. 4 shows a heat treatment system 400 comprising a heat treatment zone functioning as e.g. a furnace which is coupled to a heat treatment device 100 shown in FIG. 1. The heat treatment device 100 comprises the same features as the heat treatment device 100 shown in FIG. 1. For example the ambient surrounding the heat treatment device 100, is indicated by section II. In the first section I, a nitrogen atmosphere with the pressure p1 is adjusted. Between the second brush seal 112 and the further second brush seal 113, an intermediate section 109 is defined in which an atmosphere with the pressure p2 is shown. Similarly, between the second brush seal 121 and the further second brush seal 123 a further intermediate section 109' having the pressure p2 is provided. In the third section III of the chamber 103, a process gas atmosphere with the pressure p3 is generated. The pressure p3 is smaller than the pressure p1. The pressure p1 is larger than the ambient pressure p0 and smaller than the pressure p2.

The heat treatment device 100 may be integrally coupled to the heat treatment system 400. Alternatively, the heat treatment device 100 may be exchangeably coupled to the heat treatment system 400. The heat treatment device 100 may therefore be retrofitted to conventional heat treatment systems 400, i.e. furnaces.

At an exit of the housing 102, a first shutter element 402 and a second shutter element 403 are arranged. The workpiece 101 is driven between the first shutter element 42 and the second shutter element 403. The shutter elements 402, 403 may be driven in the direction to each other until both shutter elements 402, 403 contacts the workpiece 101 for sealing purposes. For example, in an emergency (e.g. if the strip shaped workpiece cracks, both shutter elements 402, 403 may seal the exit of the housing 102.

Downstream of the exit with respect to the moving direction 105 of the workpiece 101 an intermediate tunnel section 406 is arranged between the housing 102 and a heat treatment system 400. The intermediate tunnel section 406 may comprise cooling elements 404, 405, in particular water cooling elements. Alternatively, the intermediate tunnel section 406 may also comprise heating elements for heating the workpiece 101, for example. In the intermediate tunnel section 406, a fourth section IV is defined. Downstream of the intermediate tunnel section 406, the workpiece 101 runs through the heat treatment system 400 forming a fifth section V. In the heat treatment zone 400, a high purity atmosphere up to a high hydrogen concentration may be generated. The heat treatment system 400 may be a high temperature furnace, for example. The workpiece 101 may be driven by a further roller 401.

It should be noted that the terms "containing/comprised of/including" do not exclude other elements or steps and "a" or "an" does not exclude a plurality. Also, elements described in association with different embodiments may be combined. It should also be noted that reference characters in the claims should not be construed as limiting the scope of the claims.

List of reference characters:

100 heat treatment device
101 workpiece
102 housing
103 chamber
104 pretensioning device
105 moving direction
106 first inlet
107 second inlet
108 third inlet
109 intermediate section
110 first roller
111 first brush seal
112 second brush seal
113 further second brush seal
114 dividing wall
115 further dividing wall
116 further dividing wall
117 rotating axis -continued

| List of reference characters: |
|---|
| 120 second roller |
| 121 first brush seal |
| 122 second brush seal |
| 123 further second brush seal |
| 201 brushes |
| 202 brush holder |
| 203 brush adjusting device |
| 330 third roller |
| 331 further first brush seal |
| 332 second brush seal |
| 333 further second brush seal |
| 334 third brush seal |
| 400 heat treatment system |
| 401 further roller |
| 402 shutter element |
| 403 shutter element |
| 404 water cooling element |
| 405 water cooling element |
| 406 intermediate tunnel section |
| I first section |
| II second section |
| III third section |
| IV fourth section |
| V fifth section |

What is claimed is:

1. A heat treatment device (100) for a thermal treatment of a workpiece (101), the heat treatment device (100) comprising:

a housing (102) housing a chamber (103) configured to accommodate the workpiece (101) for providing the thermal treatment;

a first roller (110) configured to support the workpiece (101) and move the workpiece (101) in a moving direction (105);

a first brush seal (111), wherein the first roller (110) and the first brush seal (111) are arranged relative to each other such that a first side of the workpiece (101) contacts the first roller (110) and a second side of the workpiece (101), wherein the second side is opposed to the first side, contacts the first brush seal (111) such that the first roller (110) and the first brush seal (111) seal at least a first section (I) of the chamber (103) from a second section (II) of the chamber (103).

2. The heat treatment device (100) according to claim 1, further comprising a driving unit operatively connected to the first roller (110) to drive the first roller (110) such that the first roller (110) drives the workpiece (101) along in the moving direction (105).

3. The heat treatment device (100) according to claim 1, wherein the first roller (110) is adjustable relative to the first brush seal (111) such that a distance between the first roller (110) and the first brush seal (111) is adjustable.

4. The heat treatment device (100) according to claim 1, wherein the first roller (110) is adjustable in the moving direction (105).

5. The heat treatment device (100) according to claim 1, wherein the first brush seal (111) is adjustable relative to the first roller (110) such that a distance between the first roller (110) and the first brush seal (111) is adjustable.

6. The heat treatment device (100) according to claim 5, further comprising a pretensioning device (104) configured to pretension the first brush seal (111) relative to the first roller (110) such that the pretensioning device (104) presses the first brush seal (111) in a direction toward the first roller (110).

7. The heat treatment device (100) according to claim 1, wherein the first brush seal (111) is adjustable in the moving direction (105).

8. The heat treatment device (100) according to claim 1, wherein the first brush seal (111) is adjustable in the moving direction (105) and is adjustable in a direction parallel to an axial direction of a rotary axis of the first roller (110).

9. The heat treatment device (100) according to claim 1, wherein the first brush seal (111) is adjustable in a direction parallel to an axial direction of a rotary axis of the first roller (110).

10. The heat treatment device (100) according to claim 1, wherein the first brush seal (111) comprises brushes (201) and further comprises a brush holder (202) for holding the brushes (201).

11. The heat treatment device (100) according to claim 10, wherein the first brush seal (111) further comprises a brush adjusting device (203), wherein the brush adjusting device (203) is configured to move the brushes (201) relative to the brush holder (202) such that a length of the brushes between the brush holder (202) and the first roller (110) is adjustable.

12. The heat treatment device (100) according to claim 1, further comprising a dividing wall (114) dividing partially the first section (I) from the second section (II), wherein the dividing wall (114) extends from the housing (102) into the chamber (103), and wherein the first brush seal (110) is fixed to the dividing wall (114).

13. The heat treatment device (100) according to claim 1, further comprising a second brush seal (112), wherein the second brush seal (112) contacts the first roller (110) such that the first roller (110) and the second brush seal (112) additionally seal the first section (I) of the chamber (103) from the second section (II) of the chamber (103).

14. The heat treatment device (100) according to claim 1, further comprising two second brush seals (112, 113) spaced apart from each other, wherein the two second brush seals (112, 113) contact the first roller (110) such that the first roller (110) and the two second brush seals (112, 113) additionally seal the first section (I) of the chamber (103) from the second section (II) of the chamber (103).

15. The heat treatment device (100) according to claim 1, further comprising a second roller (120) and a third brush seal (334) arranged spaced apart from the second roller (12) in the moving direction (105), wherein the third brush seal (334) is arranged spaced apart in the moving direction (105) from the first brush seal (111), wherein the first roller (110) and the third brush seal (334) are arranged relative to each other such that the first side of the workpiece (101) contacts the first roller (110) and the second side of the workpiece (101) contacts the third brush seal (334).

16. The heat treatment device (100) according to claim 1, further comprising:

a second roller (120) spaced apart from the first roller (110) in the moving direction (105) and configured to support the workpiece (101);

a further first brush seal (121);

wherein the second roller (120) and the further first brush seal (121) are arranged relative to each other such that a further first side of the workpiece (101) contacts the second roller (120) and a further second side of the workpiece (101), which further second side is opposed to the further first side, contacts the further first brush seal (121) such that the second roller (120) and the further first brush seal (121) seal at least the first section (I) or a further section of the chamber (103) from a third section (III) of the chamber (103).

17. The heat treatment device (100) according to claim 1, wherein the workpiece is a strip-shaped workpiece (101).

18. A method of operating a heat treatment device (100) according to claim 1 for thermal treatment of a workpiece (101), the method comprising:

arranging the workpiece (101) in the chamber (103) for providing a thermal treatment;

moving the workpiece (101) along in a moving direction (105) between the first section (I) for providing a thermal treatment and the second section (II) for providing a thermal treatment.

19. The method according to claim 18, wherein the workpiece is a strip-shaped workpiece (101).

* * * * *